US009415594B1

(12) United States Patent
Stephens

(10) Patent No.: US 9,415,594 B1
(45) Date of Patent: Aug. 16, 2016

(54) SINGLE JET HAVING A BUBBLE SCREEN

(71) Applicant: XEROX CORPORATION, Nowalk, CT (US)

(72) Inventor: Terrance L. Stephens, Canby, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/814,024

(22) Filed: Jul. 30, 2015

(51) Int. Cl.
*B41J 2/14* (2006.01)

(52) U.S. Cl.
CPC ..... *B41J 2/14274* (2013.01); *B41J 2/14233* (2013.01); *B41J 2202/07* (2013.01)

(58) Field of Classification Search
CPC ..... B41J 2/19; B41J 2202/07; B41J 2/14201; B41J 2/14233; B41J 2002/14266; B41J 2/14274
See application file for complete search history.

(56) References Cited

U.S. PATENT DOCUMENTS 5,610,645 A * 3/1997 Moore ..... B41J 2/161 210/498
2013/0070018 A1* 3/2013 Sasaki ..... B41J 2/14274 347/34

* cited by examiner

*Primary Examiner* — Geoffrey Mruk
(74) *Attorney, Agent, or Firm* — Marger Johnson

(57) ABSTRACT

A jet stack includes a set of plates forming an array of body chambers, the set of plates including a nozzle plate having an array of jets wherein each jet corresponds to a body chamber, each body chamber having a body chamber port that allows fluid to flow into and out of the body chamber, and a bubble screen between the body chamber port and a remainder of the jet.

10 Claims, 6 Drawing Sheets

SINGLE JET HAVING A BUBBLE SCREEN

TECHNICAL FIELD

This disclosure relates to print head architectures, more particularly to parallel jet architectures.

BACKGROUND

Inkjet print heads typically include a 'jet stack,' a stack of plates that form manifolds and chambers of an ink path from an ink reservoir to an array of single jets, each of which having a nozzle. Ink enters the jet stack from the reservoir and is routed through the ink path to the final plate that contains an array of nozzles through which the ink selectively exits the jet stack. In a selective fashion, signals drive an array of transducers that operate on pressure chambers or body chambers associated with each single jet. When a particular transducer receives a signal to jet the ink, it pushes ink out of the body chamber through the jet and its nozzle to the printing surface.

The desire for higher resolution images, and increased throughput, results in the need for higher and higher packing density for the jets. The packing density is the number of jets that exist within some predefined space. Space requirements for each jet limit the number of jets that can fit within that space. Current print head designs typically have a serial flow path. Fluid flows into the body chamber through a first discrete fluid element and then flows out of the body chamber through a second discrete fluid element that leads to the corresponding single jet aperture. Each of these fluid elements use a certain amount of real estate associated with the jet stack and require some distance between them for separation as well. These effects act to limit the number of single jets that can be packed within the space of any given jet stack.

As set out in U.S. patent application Ser. No. 14/095,127, filed Dec. 3, 2013, it is possible to use a parallel flow single jet architecture to increase packing density. However, this single jet architecture lacks crossflow of ink into and out of the driver body volume that exists in the serial jet architectures. Further, if the parallel flow single jet architecture is oriented with the exit portion of the jet facing downward during use, and a bubble is introduced into the jet, buoyancy will tend to direct the bubble into the body chamber. Once inside the body chamber, and due to the lack of crossflow of ink into and out of the driver body, the bubble is difficult to remove without changing orientation of the print head, applying vacuum, or through slow absorption into the jetting fluid. As long as the bubble remains within the body chamber, the jet is rendered non-functional.

SUMMARY

One embodiment comprises a jet stack for an ink jet printer. The jet stack includes a set of plates forming an array of body chambers, the set of plates including a nozzle plate having an array of jets wherein each jet corresponds to a body chamber, each body chamber having a body chamber port that allows fluid to flow into and out of the body chamber, and a bubble screen between the body chamber port and a remainder of the jet.

DETAILED DESCRIPTION OF THE EMBODIMENTS

Figure 1:
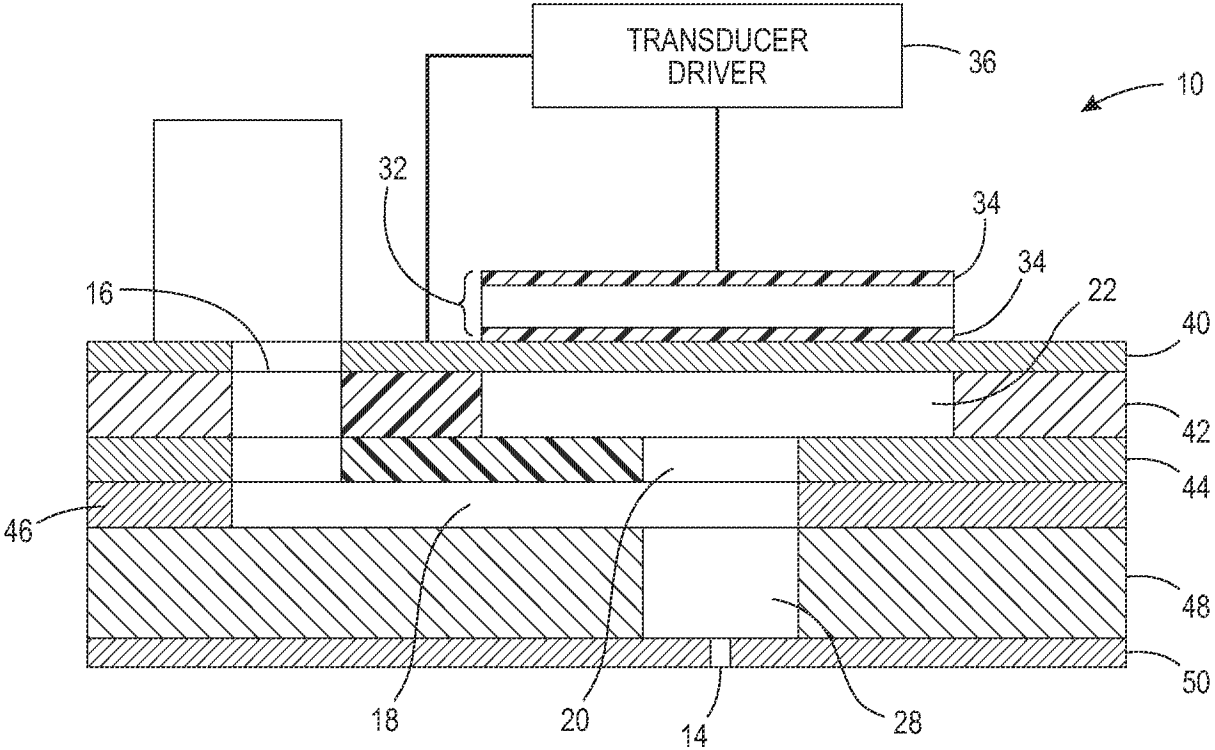
FIG. 1 shows a side view of an inkjet jet stack having a parallel flow single jet structure without a bubble screen.

FIG. 1 shows an example of a single jet 10 in a jet stack. In this example, the jet stack consists of a particular number and configuration of plates with the understanding that the actual composition of the jet stack may vary, as well as the variation in the particular components, such as the type and construction of the transducer, etc. Further, while the particular fluid discussed here is ink within an inkjet printer, the embodiments here may apply to other types of fluid dispensing elements. The jet stack typically encompasses an array of jets, each with their own corresponding inlet channel, body chamber port, body chamber, outlet, and nozzle or aperture. The jets are the individual elements, referred to here as jet or jetting elements. The term jet here encompasses all of the elements that direct the ink, including the inlet channel, body chamber port, body chamber, outlet, and ultimately the nozzle or aperture.

In the example of FIG. 1, the jet element consists of an ink path starting with an inlet port 16, an inlet channel 18, and a body chamber port 20 directing ink to the body chamber 22. Ink flows in and out of the body chamber through the body chamber port in fluidic communication with the outlet 28, and ultimately exits the jet stack through the nozzle or aperture 14. The transducer 32 actuates in response to a signal from the transducer driver 36 to the transducer elements 34. In this particular example, the transducer deforms in response to the signal, first to deform away from the body chamber to draw ink into the chamber. The transducer then pushes towards the body chamber to force ink in the body chamber out to the nozzle or aperture. The channels, ports, chambers, and nozzle shown in FIG. 1 are formed from a series of plates, such as the diaphragm plate 40, body chamber plate 42, body chamber port plate 44, inlet channel plate 46, outlet plate 48 and nozzle plate 50.

Figure 2:
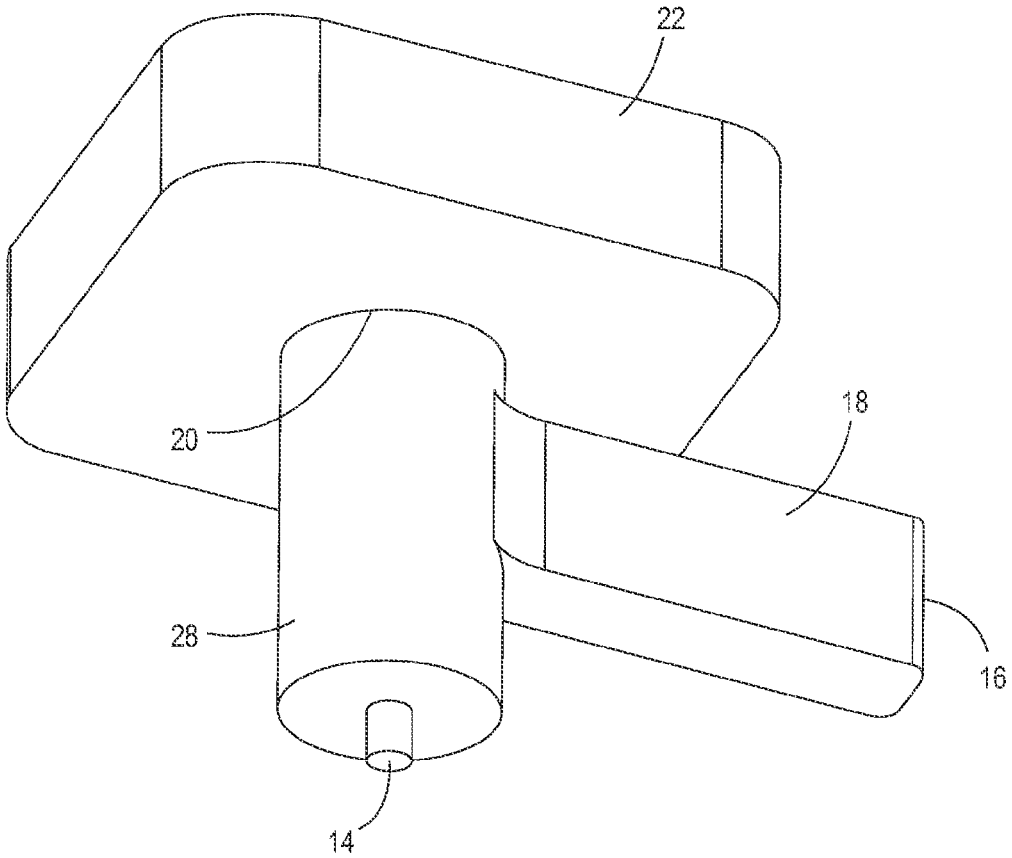
FIG. 2 shows a three-dimensional view of a parallel flow, single jet structure without a bubble screen.

FIG. 2 shows a three-dimensional view of a parallel flow, single jet structure without a bubble screen. Similar to the example shown in FIG. 1, the jet element shown in FIG. 2 begins with the inlet port 16 to an inlet channel 18, and a body chamber port 20 directing ink to the body chamber 22. Ink flows in and out of the body chamber through the body chamber port in fluidic communication with the outlet 28, and ultimately exits the jet stack through the nozzle or aperture 14.

Figure 3:
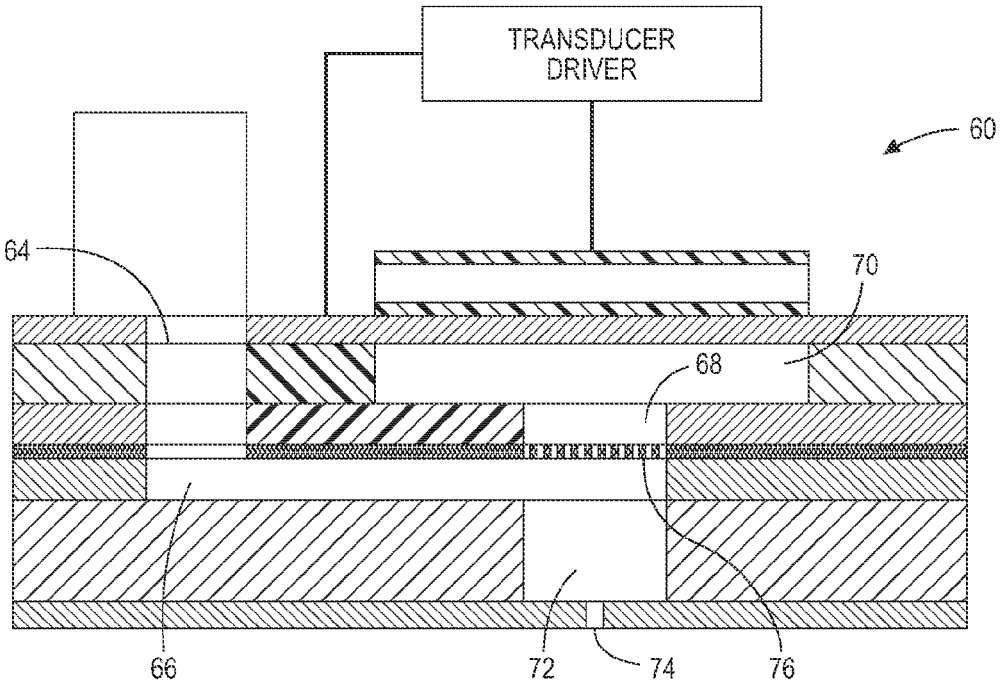
FIG. 3 shows a side view of an embodiment of a single jet structure with a bubble screen.
Figure 4:
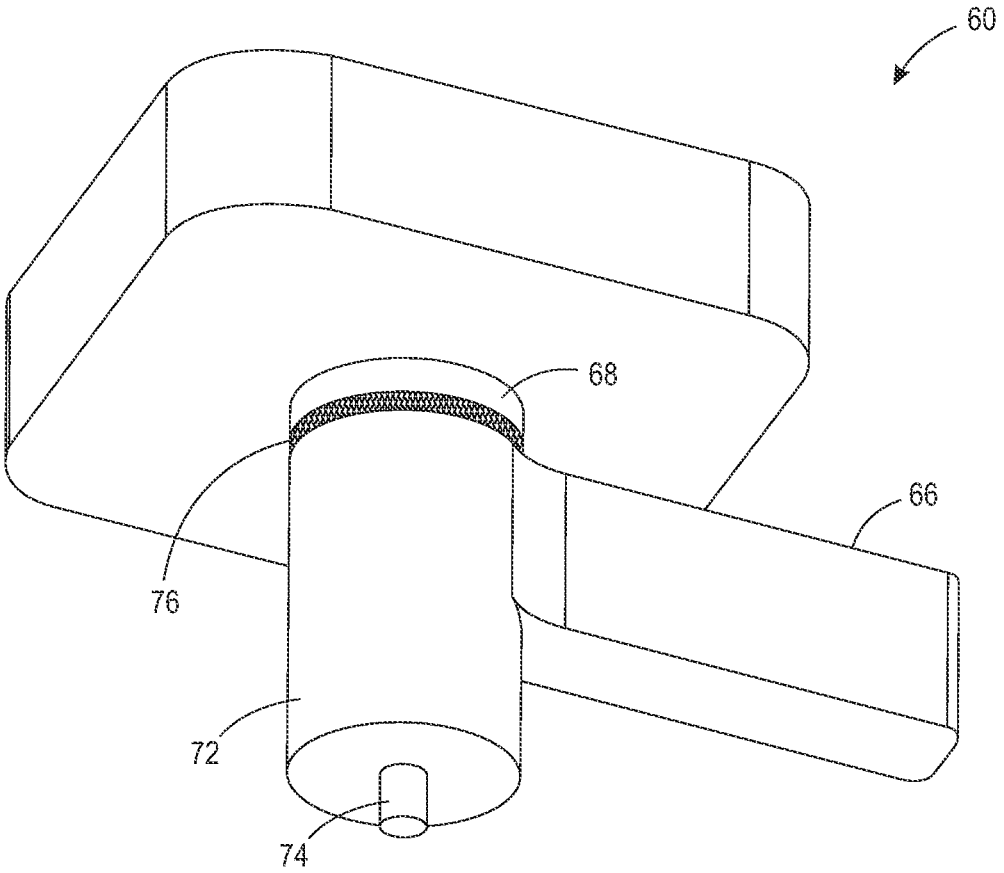
FIG. 4 shows a three-dimensional view of a parallel flow, single jet structure with a bubble screen.

FIG. 3 shows an embodiment of a single jet architecture 60 having a bubble screen. Similar to FIG. 1, the single jet 60 has an inlet port 64, and inlet channel 66, a body chamber port 68, a body chamber 70, an outlet 72, a nozzle or aperture 74, and additionally a bubble screen 76, the bubble screen located between the body chamber port and the remainder of the single jet structure. FIG. 4 shows a three-dimensional view of an embodiment of a single jet architecture 60 having a bubble screen. The bubble screen 76 resides between the body chamber port 68 and the remainder of the jet shown by the outlet 72.

Through multiple mechanisms, it is possible for air to be introduced into the single jet structure from either the inlet path or nozzle itself. As long as the bubble remains within a portion of the single jet, including the body chamber, the jet is rendered non-functional. In the case of such an event, the system is caused to undergo a purge cycle, whereby ink is forced to flow into the entrance of the inlet path and out of the nozzle of the single jet by applying a pressure differential between the fluid structure supplying ink to the inlet path and the nozzle or array of nozzles. During this process, air located within the flow path of the fluid structure is caused to flow out of the single jet through the single jet nozzle.

Figure 5:
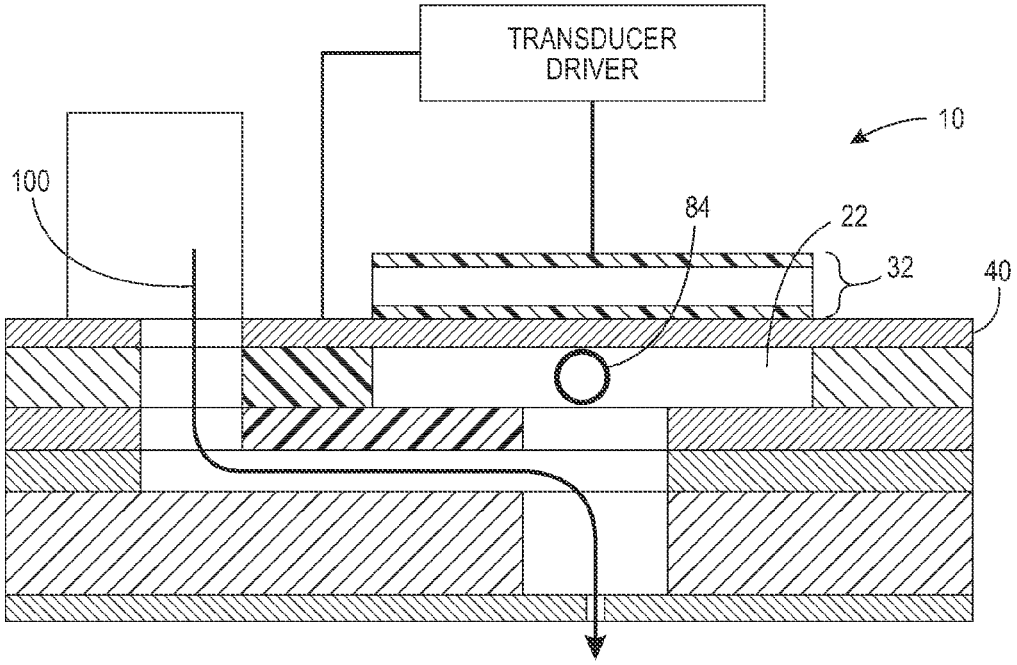
FIG. 5 shows a side view of an inkjet jet stack having a parallel flow single jet structure without a bubble screen and with a bubble inside the driver body chamber.

FIG. 5 shows a side view of an inkjet jet stack 10 having a parallel flow single jet structure without a bubble screen and with a bubble 84 inside the driver body chamber 22.

Arrow 100 shows the ink flow path during a purge cycle as described above. As shown by arrow 100, the ink flow path bi-passes the bubble because the bubble is located within the body chamber, a stagnation zone during purge. Thus, the bubble does not get entrained during purge, and is un-purgeable.

Figure 6:
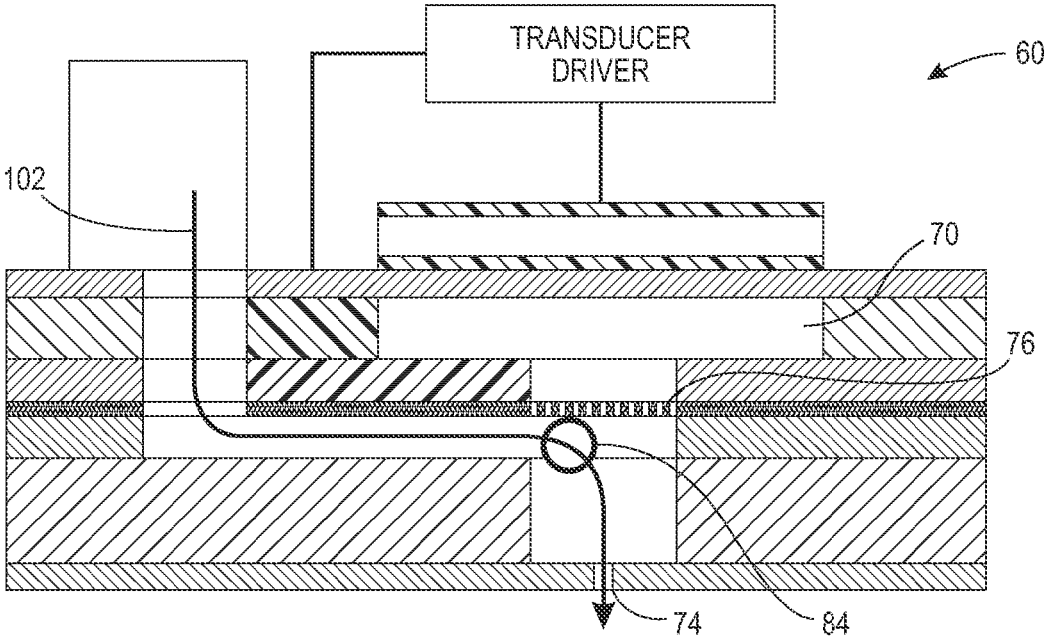
FIG. 6 shows a side view of an inkjet jet stack having a parallel flow single jet structure with a bubble screen and a bubble against the bubble screen.

FIG. 6 shows a side view of an inkjet jet stack having a parallel flow single jet structure with a bubble screen 76 and with a bubble 84 resting against the bubble screen. Arrow 102 shows the ink flow path during a purge cycle in the inkjet stack having the bubble screen. As shown by arrow 102 the bubble, resting against the bubble screen, is located within the flow path. Because the bubble is located within the flow path, it will become entrained during purge and exit the single jet through the single jet nozzle.

Figure 7:
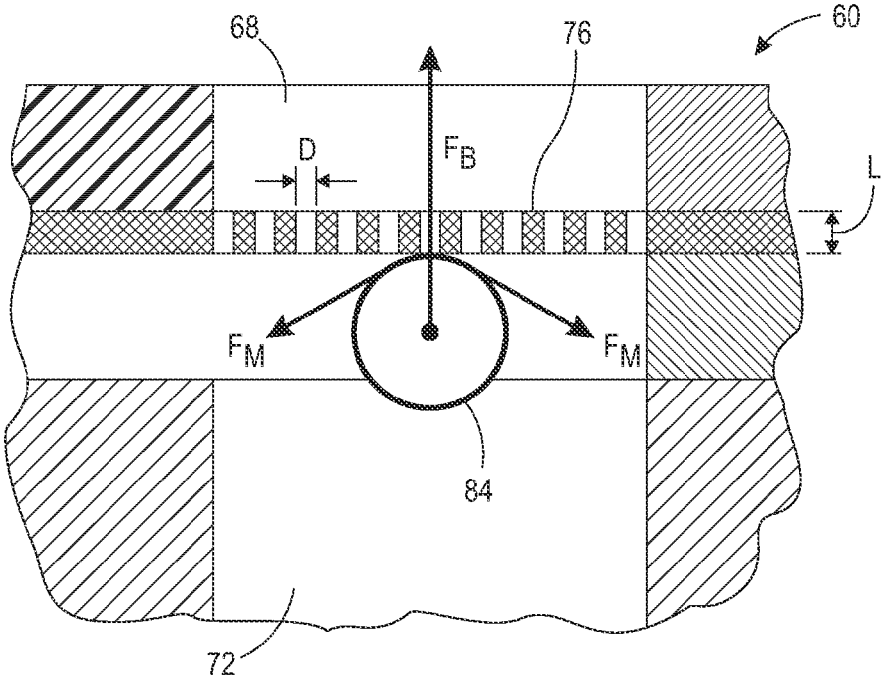
FIG. 7 shows an additional side view of an inkjet jet stack having a parallel flow single jet structure with a bubble screen and a bubble against the bubble screen.

FIG. 7 shows an enlarged view of the bubble screen 76 located between the body chamber port 68 and the remainder of the jet 72, as well as a bubble 84 resting against the bubble screen. One can see that buoyancy is acting to force the bubble up through the bubble screen holes, while the meniscus force is acting to keep the bubble below the bubble screen holes. In order to keep the bubble from rising through the holes, the diameter of the holes, D, must be appropriately sized to generate a meniscus strength, $F_M$, greater than the buoyancy force, FB, exerted by the bubble.

Further, in order to retain adequate performance during jetting, the number of holes N, length L, and diameter D of holes must be such that an acceptably small amount of impedance is introduced between the body chamber and the remainder of the single jet. The length, L, is shown in FIG. 7.

In order to satisfy these two requirements, the following relationship, M, should have a value of less than approximately 0.001 but not more than 0.01: $M=(L)/(N*(D)^2)$. The hole diameter D should be less than about 18 micrometers (ums) but not more than 50 ums. Note that these measurements are in micrometers to maintain the proper scaling of ratios. In this manner, an inkjet print head can achieve higher jet density with a parallel flow single jet architecture, but without the issues that result from the lack of the crossflow of ink within the body chamber.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A jet stack, comprising:

a set of plates forming an array of body chambers, the set of plates including a nozzle plate having an array of jets wherein each jet corresponds to a body chamber;

each body chamber having a body chamber port that allows fluid to flow into and out of the body chamber;

an inlet channel connected to body chamber port to allow fluid to reach the body chamber port;

an inlet port connected to the inlet channel to allow fluid to enter the inlet channel; and a bubble screen between the body chamber port and a remainder of the jet.

2. The jet stack of claim 1, wherein the fluid comprises ink.

3. The set of plates of claim 1, wherein the jet stack forms a flow path in which bubbles trapped by the bubble screen are in the flow path.

4. The jet stack of claim 1, wherein the flow path comprises a path from the inlet port through the inlet channel and an outlet to an output nozzle.

5. The jet stack of claim 1, wherein the set of plates includes a diaphragm plate, a body chamber plate, a body chamber port plate, an inlet channel plate, a bubble screen plate, an outlet plate and nozzle plate.

6. The jet stack of claim 1, wherein the bubble screen includes an array of holes.

7. The jet stack of claim 6, wherein a diameter of each hole has a size selected to generate a meniscus force greater than a buoyance force of a bubble.

8. The jet stack of claim 6, wherein the array of holes have a relationship, M, between a number of holes, N, a length of each hole, L, and a diameter of each hole, D, defined by $M=(L)/(N*(D)^2)$.

9. The jet stack of claim 6, wherein each hole has a diameter less than 18 micrometers.

10. The jet stack of claim 6, wherein each hole has a diameter less than 50 micrometers.

* * * * *